United States Patent [19]

Call

[11] Patent Number: 4,841,260

[45] Date of Patent: Jun. 20, 1989

[54] HALF WAVE PLATE

[75] Inventor: William F. Call, Bellingham, Mass.

[73] Assignee: Epsco, Incorporated, Hopkinton, Mass.

[21] Appl. No.: 3,207

[22] Filed: Jan. 14, 1987

[51] Int. Cl.[4] ..... H01P 1/165

[52] U.S. Cl. ..... 333/21 A; 333/137; 333/248

[58] Field of Search ..... 333/109, 113, 21 A, 333/256, 257, 159, 126, 135, 248, 137

[56] References Cited

U.S. PATENT DOCUMENTS

| | | | |
|---|---|---|---|
| 2,713,151 | 7/1955 | Farr | 333/257 X |
| 2,930,040 | 3/1960 | Weil | 333/21 A X |
| 3,215,957 | 11/1965 | Dantzig et al. | 333/256 X |
| 4,367,446 | 1/1983 | Hall | 333/135 |
| 4,520,329 | 5/1985 | D'Oro et al. | 333/21 A X |

FOREIGN PATENT DOCUMENTS

| | | | |
|---|---|---|---|
| 220601 | 11/1985 | Japan | 333/21 A |

*Primary Examiner*—Paul Gensler

*Attorney, Agent, or Firm*—Donald Brown

[57] ABSTRACT

A microwave device including a half wave plate for a microwave power combiner, attenuator or variable coupler divider having a circular waveguide portion and a pair of cavities disposed opposite to one another and each coupled to a plurality of slots formed in a wall between said cavities and said circular waveguide. The half wave plate is used to obtain a phase shift in the signals provided to one end of the circular waveguide and is preferably mounted for rotary motion about the center axis of the circular waveguide.

2 Claims, 1 Drawing Sheet

HALF WAVE PLATE

BACKGROUND OF THE INVENTION

This invention is directed to a new and improved microwave device useful in structures such as power combiners, attenuators or variable couplers (dividers) which can operate at high power levels. In particular, this invention is directed to as new and improved half wave plate which is mounted for rotation so that when it is rotated, power from two input ports ocupled to the input thereof can be combined at one or two output ports coupled to the output thereof based on the degree of rotation of the plate.

Power combiners, dividers, attenuators are used in applications such a communication satellite earth stations. By rotation of the half wave plate of this invention when used as part of a combiner, the combiner can sum the outputs of power amplifiers into a single antenna coupled to one output port. When used in reverse mode, the device which would enable two antennas to serve one link up, e.g., when two satellites must be observed from a single earth station.

BRIEF DESCRIPTION OF THE DRAWINGS

FIG. 6 shows an enlarged top view of an orthogonal mode tee which may be used;

FIG. 7 shows one input side of the tee looking towards it from arrow lines 7—7;

FIG. 8 shows the opposite input side looking at it from arrow lines 8—8; and FIG. 9 shows the front looking at it from arrow lines 9—9 and showing the portion which is coupled to the choke input.

BRIEF STATEMENT OF THE INVENTION

The invention is directed to a half wave plate mounted for rotary motion in e.g. rotary chokes at each end and adapted to be coupled to junction devices such as orthogonal (ORTHO) mode tees such as shown in my U.S. pending patent application Ser. No. 866,322, filed May 22, 1986, the entire contents of which are incorporated herein by reference hereto.

The half wave plate of this invention comprises a circular waveguide having two open ends and a pair of cavities oppositively disposed to one another and each cavity coupled to said circular waveguide by a plurality of slots.

DETAILED DESCRIPTION OF THE INVENTION

Figure 1:
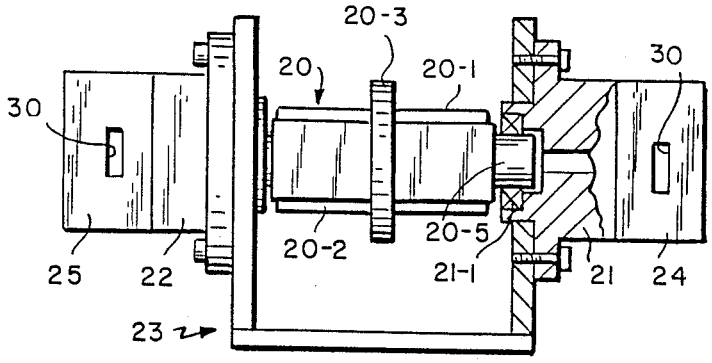
FIG. 1 is a side view variable power combiner.

Reference should now be had to FIGS. 1 to 5 which illustrate the invention herein. Referring first to FIG. 1 this shows the combination of the half wave plate 20 mounted for rotation in two conventional rotary chokes 21 and 22 supported by a frame 23 had having preferably two orthogonal mode tees 24 and 25 for coupling energy in the form of circularly polarized signals thereto, e.g. in Q band at frequencies of 33 to 50 GHz. It should be understood that orthogonal mode tees of a different configuration may also be used in conjunction with the half wave plate 20 and therefore the invention is not limited to the aforementioned tee.

Figure 2:
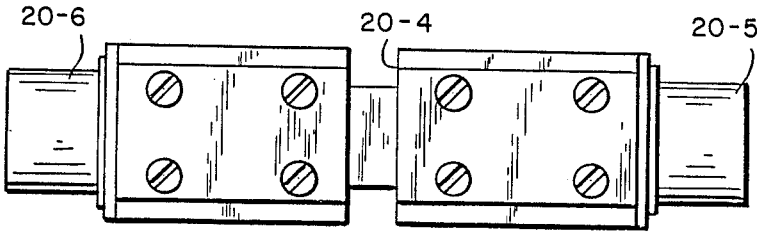
FIG. 2 is a top plan view of the half wave plate.
Figure 3:
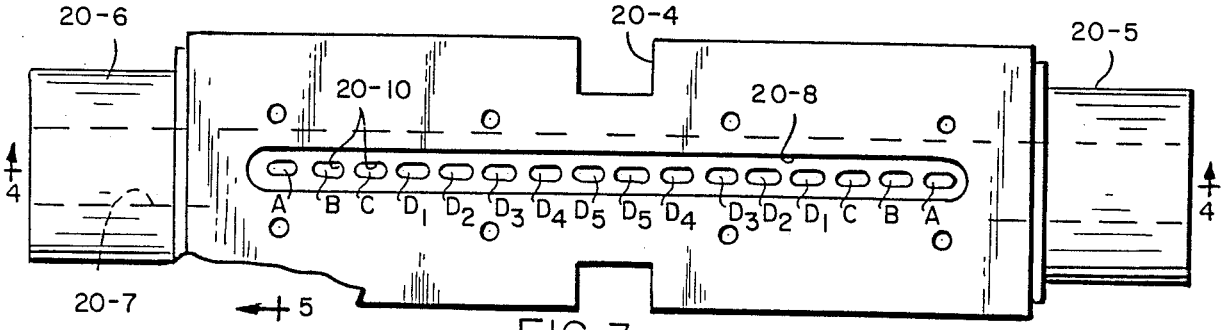
FIG. 3 is a top plan view of the half wave plate according to the invention with the cover removed.
Figure 4:
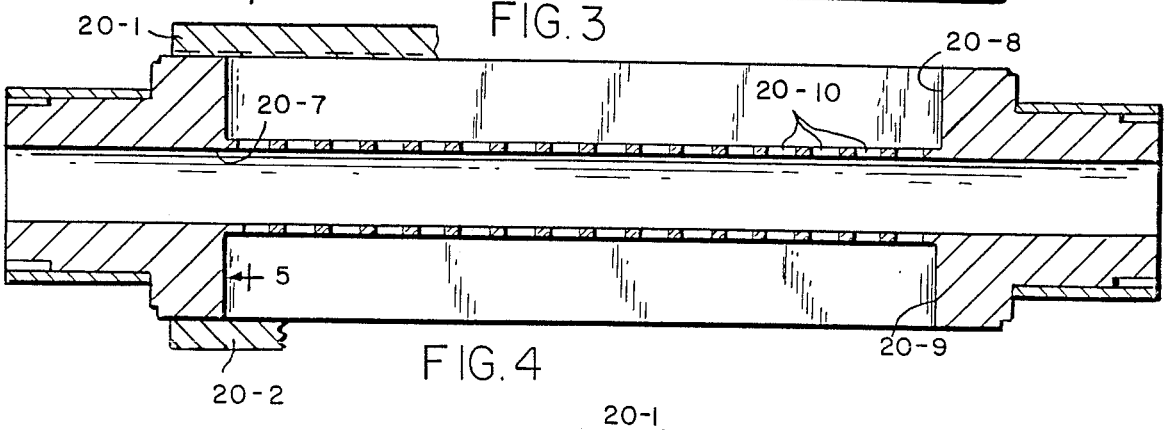
FIG. 4 is a sectional view taken along lines 4—4 in FIG. 3.
Figure 5:
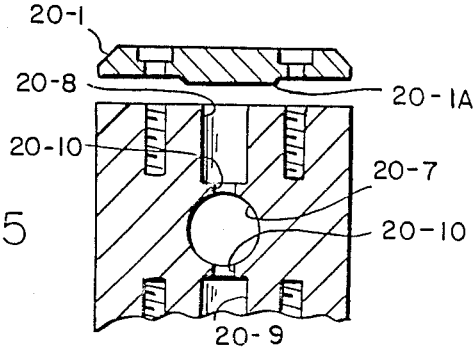
FIG. 5 is a sectional view taken along line 5—5 in FIG. 4.

In FIG. 1 the half wave plate is shown with covers 20-1 and 20-2 which are held in place by screws (See FIG. 2). A rotatable geared (knurled) member 20-3 is positioned in a channel 20-4 of the half wave plate 20 and is attached thereto, e.g. by a screw or glue to rotate the half wave plate having its ends 20-5 and 20-6 supported by the rotary chokes 21 and 22 (See FIGS. 2 and 3) in the races thereof (one being shown at 21-1). By rotating the gear, e.g. by hand or with a gear train (not shown) the angular position of the half wave plate may be changed.

Reference should now be had to FIGS. 2 to 5 which show the half wave plate in greater detail. A circular waveguide 20-7 extends the length of the half wave plate 20. Two cavities (channels) 20-8 and 20-9 are positioned opposite each other and are coupled to the circular waveguide by a plurality of slots 20-10. The covers 20-1 and 20-2 are each provided with a small step (20-1A being shown in FIG. 5) to achieve a good seal between the copper parts when the cover is screwed onto the main body of the half wave plate.

FIG. 6 shows an enlarged top view of an orthogonal mode tee which may be used; FIG. 7 shows one input side of the tee looking towards it from arrow lines 7—7.

FIG. 8 shows the opposite input side looking at it from arrow lines 8—8 and FIG. 9 shows the front looking at it from arrow lines 9—9 and showing the portion which is coupled to the choke input.

Referring now to FIGS. 6 to 9, these show the surfaces of an orthogonal mode tee 24 or 25 which contains the waveguide ports 30 and 31 for connection to external devices, e.g. power amplifiers, antennas, dummy loads and the like, and the choke input connection at 32. The tee can be internally constructed as shown in FIGS. 12 to 16 of my application Ser. No. 866,322, filed May 22, 1986 which is incorporated by reference hereto, although it is understood that other tees or couplers may also be used. In a power combiner mode ports 30 and 31 of tee 25 are each provided with 200 watts power operating in the $TE_{11}$ mode in order to swtich power between ports 30 and 31 of tee 24. At 0° rotation (the position shown in FIG. 1) the power output at port 30 of tee 24 is 400 watts and at port 31 is about 0 at clockwise rotation of 22° of the plate the power output at port 30 and 31 of tee 24 is about 200 watts at each port at 45° of clockwise rotation the power output at port 31 is about 400 watts and at port 30 of tee 24 is about 0.

In operation the half wave plate receives circularly polarized signal at one end of the circular guide 20-7, e.g. at a 43 $GH_z$ center frequency. The signal is coupled through the slots 20-10 into the cavities 20-8 and 20-9 and then short circuited back into the circular guide to obtain a phase shift of about a half a wavelength in the signal at the other end of the guide.

In order to construct a suitable half wave plate for a center frequency of 43 $GH_z$ with a 33 to 50 $GH_z$ waveband the following dimensions in inches have been found suitable:

I claim:

1. A microwve device comprising a member defining an axial circular waveguide wall, said member also defining a pair of cavities positioned on opposite longitudinal sides of said waveguide wall a plurality of slots in the wall between said circular waveguide and each of said cavities, said cavities having two side broad walls, two narrow end walls and a top wall opposite said slots in width than the width of said side walls, and means for supporting said member for rotation.

2. The device according to claim 1 in which each of said cavities are defined by five walls and a cover.

* * * * *